United States Patent [19]

Gilbert et al.

[11] Patent Number: 4,886,076

[45] Date of Patent: Dec. 12, 1989

[54] CIGARETTE SNUFFER

[76] Inventors: Leslie C. Gilbert, 207 Portree Dr., Dunedin, Fla. 34698; Leo M. J. Rushlow, 3466 Moberly, Milford, Mich. 48042

[21] Appl. No.: 75,538

[22] Filed: Jul. 20, 1987

[51] Int. Cl.[4] ..... A24C 1/00

[52] U.S. Cl. ..... 131/256; 131/235.1; 131/237

[58] Field of Search ..... 131/256, 235.1, 237

[56] References Cited

U.S. PATENT DOCUMENTS 2,619,093 11/1952 Fontneau ..... 131/256
2,715,961 8/1955 Field ..... 131/256

FOREIGN PATENT DOCUMENTS 0009624 7/1915 United Kingdom ..... 131/256

*Primary Examiner*—V. Millin
*Attorney, Agent, or Firm*—Charles W. Chandler

[57] ABSTRACT

A method and a device for safely snuffing a lighted cigarette, includes a body having a top opening, a tapered interior, and a rounded closed bottom. The top opening which receives the lighted cigarette has a diameter substantially corresponding to the diameter of the cigarette. The interior is gradually tapered to a diameter less than that of the cigarette so that the cigarette is squeezed as it is being inserted toward the bottom. The squeezing and insertion motion is terminated prior to the ash being destroyed so that the ash remains intact as the cigarette is being extinguished.

7 Claims, 1 Drawing Sheet

CIGARETTE SNUFFER

BACKGROUND OF THE INVENTION

This invention is related to a cigarette snuffer having a tapered opening and a closed bottom so as to progressively squeeze the lighted end of a cigarette and extinguish it without destroying the cigarette ash.

Cigarette snuffers have long been used for extinguishing a cigarette and usually comprise a cylindrical body having a top opening into which the cigarette is inserted, and a closed bottom. The cigarette is usually inserted into the opening with the ash being mashed in the bottom of the body. As the cigarette is inserted into the body, the absence of oxygen retards and finally smothers the lighted end of the cigarette. An example of such prior art is to be found in U.S. Pat. No. 2,227,354 which issued to P. S. Kushiner on Dec. 31, 1940.

One of the problems with such snuffers is that when the cigarette ash is destroyed, the cigarette usually has an undesirable taste when relit. Further, the ash residue in the snuffer is messy, and difficult to clean.

SUMMARY OF THE INVENTION

The broad purpose of the present invention is to provide an improved cigarette snuffer comprising a body having an opening with an initial diameter suited for receiving the cigarette, and then an extinguishing section which is tapered so as to terminate with a closed semi-spherical bottom. The tapered, extinguishing section gradually squeezes the lighted end of the cigarette as it is being inserted into the snuffer. The cigarette is fully snuffed prior to reaching the closed bottom so that the ash need not be destroyed but remains intact.

We have found that if the ash remains intact and the cigarette is quickly smothered, the cigarette can be relighted with a relatively fresh taste. The preferred snuffer causes no flame, no smoke, and no sparks for burning carpeting or furniture. If the cigarette is to be disposed of, the user need not worry about it re-igniting should he throw it out the window of an automobile, for example.

The cigarette can be extinguished quickly in one motion. There are no messy ashes to get on the user's fingers, no fire to ignite tissues, gum wrappers, discarded cigarettes and the like previously discarded in the ashtray. It makes smoking safer in automobiles, airplanes and mass-transit because it obviates the problem of sparks being blown around by air conditioning vents and the like.

The preferred snuffer can be either spun, stamped out of metal, or molded from plastic, and incorporated in a variety of applications such as an ashtray, or with a pocket clip so that it can be inserted either into a pocket, or a cigarette package or the like.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views and in which.

DESCRIPTION OF THE PREFERRED EMBODIMENT

Figure 1:
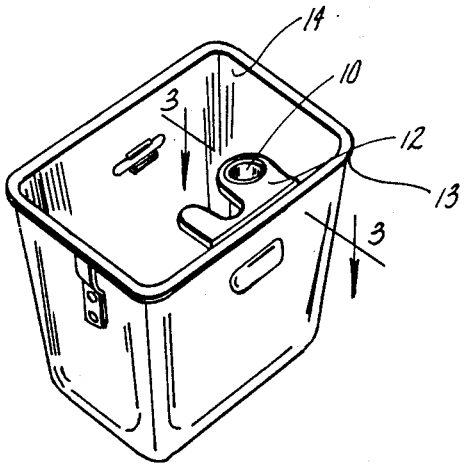
FIG. 1 is a perspective view showing the preferred snuffer in an automobile ashtray.
Figure 2:
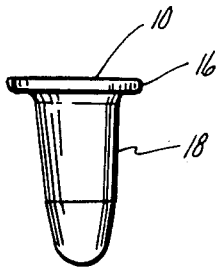
FIG. 2 is a view of the snuffer removed from the ashtray.
Figure 3:
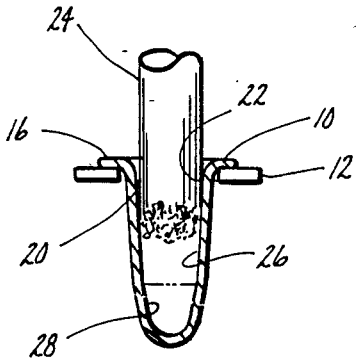
FIG. 3 is a sectional view showing a cigarette being inserted into the snuffer body.

Referring to the drawing, a preferred snuffer 10 is illustrated as being mounted on a support structure 12 inside a cup-shaped ashtray 13 which, for example, may be mounted in the passenger compartment of either an automobile, or an airplane, a home, or a mass-transit system where passenger safety is important.

Other advantages of the preferred embodiment are the cigarette can be put out quickly in one motion, the user will not have messy ashes on his fingers, there is no fire to ignite tissues, gum wrappers, discarded cigarettes and the like previously put into the ashtray thus the driver can concentrate on this driving. There are no sparks flying around from air conditioning vents such as in automobiles, airplanes, and all mass-transit.

Snuffer 10 is preferably formed of a low carbon, cold rolled steel and has an annular flange 16 adapted to support body 18 in an opening 20 in structure 12. Flange 16 defines a cigarette-receiving opening 22 which is slightly greater than the diameter of a conventional cigarette 24.

Figure 4:
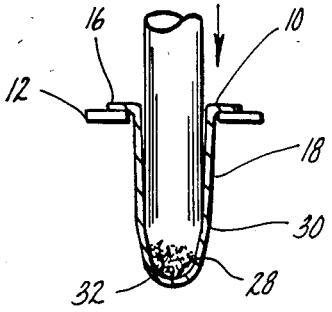
FIG. 4 is a view illustrating the extinguished cigarette in the snuffer body.

The body of the snuffer has a tapered internal surface 26 terminating in a semi-spherical rounded bottom 28. The diameter of the semi-spherical bottom is less than that of the cigarette so that the bottom third of the body, that is, extinguishing section 30, progressively squeezes the lighted end of a cigarette as it is being inserted toward the closed bottom, as illustrated in FIG. 4. This tends to quickly suffocate the cigarette without destroying ash 32 formed at the lighted end of the cigarette. The ash remains relatively intact. We have found that the cigarette thus retains its fresh flavor when relit without having the undesirable taste of a cigarette having a destroyed ash.

Figure 5:
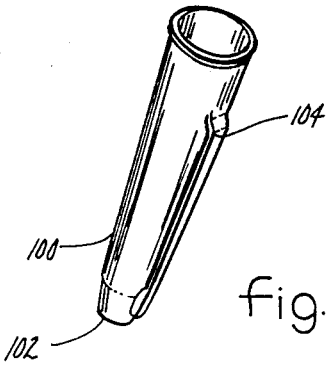
FIG. 5 is a view showing another snuffer illustrating the invention formed with a pocket clip.

FIG. 5 illustrates another embodiment of the invention in which snuffer body 100 has a rounded semi-spherical bottom 102. Body 100 is internally tapered to achieve the same snuffing characteristics of body 18 of FIGS. 1-4. In this embodiment of the invention, the open end of the body does not have a flared or annular flange, however, body 100 does support an integral pocket clip 104 so that the snuffer body can be attached to a thin object. This embodiment of the invention can be formed of any suitable material such as a molded plastic material because the extinguishing motion occurs so quickly that a metal is not required.

Having described our invention, we claim:

1. A device for snuffing a cigarette or the like having an unburned section terminating with a lighted end having a diameter slightly less than that of the unburned section, said device comprising:

a molded plastic tubular body having an open end with a diameter adapted to receive the lighted end of the cigarette, and a closed bottom, said bottom having a semispherical, interior space;

the tubular body having an interior tapered section between the open end and the closed bottom;

the tapered section having a length greater than the length of the lighted end of the cigarette;

the tapered section having a diameter along the length thereof that is gradually narrowed from said open end to a diameter less than that of the unburned section of the cigarette spaced from the closed bottom a distance at least as great as the length of the lighted end of the cigarette;

the semispherical closed bottom having a diameter slightly less than that of the unburned section of the cigarette;

wherein the diameters of the tapered section and the closed bottom are dimensioned such that the unburned section of the cigarette is squeezed by the tapered section of the tubular body as the cigarette is being inserted into the tapered section to form a snug fit between the cigarette and the tubular body to enclose and extinguish the lighted end adjacent the semi-spherical surface of the closed bottom to form an ash that is intact when removed from the tubular body.

2. A combination as defined in claim 1, in which the body has a semi-spherical, interior, bottom surface for receiving the intact ash.

3. A combination as defined in claim 3, in which the semispherical surface has a diameter less than that of the cigarette.

4. A combination as defined in claim 1, including a cupshaped ashtray, and including structure supporting the snuffer body in the ashtray.

5. A combination as defined in claim 1, including a pocket clip attached to the body.

6. A combination as defined in claim 5, in which the pocket clip is integrally attached to the body.

7. A combination as defined in claim 1, in which the body has an annular flange defining the open end of the body.

* * * * *